US006443775B2

(12) United States Patent
Chen et al.

(10) Patent No.: US 6,443,775 B2
(45) Date of Patent: Sep. 3, 2002

(54) MODULAR CONNECTOR

(75) Inventors: Chih-Yi Chen, Tao-Yuan; Kun-Tsan Wu, Tu-Chen, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/776,089

(22) Filed: Feb. 2, 2001

Related U.S. Application Data

(63) Continuation-in-part of application No. 29/120,615, filed on Mar. 22, 2000, and a continuation-in-part of application No. 09/447,160, filed on Nov. 22, 1999.

(30) Foreign Application Priority Data

Feb. 2, 2000 (TW) ..... 89201912 U

(51) Int. Cl.[7] ..... H01R 24/04
(52) U.S. Cl. ..... 439/676
(58) Field of Search ..... 439/676, 607–610, 439/489, 490, 540.1, 701

(56) References Cited

U.S. PATENT DOCUMENTS 5,957,730 A * 9/1999 Wang ..... 439/490
6,116,962 A * 9/2000 Laity ..... 439/676
6,157,542 A * 12/2000 Wu ..... 439/676
6,203,379 B1 * 3/2001 Cai et al. ..... 439/676

* cited by examiner

*Primary Examiner*—Gary Paumen
(74) *Attorney, Agent, or Firm*—Wei Te Chung

(57) ABSTRACT

A modular connector of the present invention comprises an insulative housing, at least two terminal modules, a shell for enclosing the insulative housing and indicating devices. The insulative housing defines at least two mating cavities in a front portion and at least two insert openings in a bottom wall thereof. The terminal modules each comprise a plurality of contacts injection molded in a spacer thereof and are inserted into the insert openings from a bottom side of the insulative housing. The indicating devices are received in first receiving grooves defined in the insulative housing for signaling circuit transmission. The shell encloses the insulative housing while providing openings for insertion of at least two mating connectors and apertures for protrusion of the indicating devices therethrough.

1 Claim, 11 Drawing Sheets

MODULAR CONNECTOR (This is a continuation-in-part application of the copending application Ser. No. 29/120,615 filed Mar. 22, 2000, and a continuation-in-part application of the copending application Ser. No. 09/447,160 filed Nov. 22, 1999.)

BACKGROUND OF THE INVENTION

The present invention relates to a connector, and particularly to a modular connector for mating with different electric connectors and comprising a group of indicating devices.

In order to make full use of the space on a PCB in computers, molded electrical connectors have become a trend in the development of computers and a number of designs for molded electrical connectors have been developed. The modular connectors disclosed in prior art Taiwan patent application Nos. 85217540 and 8609808 do not make full use of the space between electrical connectors, resulting in a modular connector that is larger than it need be. Additionally, in assembly, the insertion direction of the terminal module is the reverse of that of a mating connector, thus, when the mating connector is inserted, it tends to push the terminal module out of its position and thereby adversely affects the contact between the module and the mating connector.

FIG. 9 shows a traditional connector 1' including an insulative housing 10' enclosed in a metal shielding 20' and composed of several identical units 11'. The shielding 20' includes integrally a rectangular back shell 23' with two locking tags 22' (only one shown) on two longitudinal ends for latchable engagement with the securement slits 21' in the side shells 24' respectively.

Anyhow, if the lateral dimensions and/or the depth dimensions of the units are different from one another, such back shell 23' and the corresponding latching devices 22' 21 may not function well Hence, an improved design for a modular connector is required to overcome the disadvantages of the prior art.

BRIEF SUMMARY OF THE INVENTION

A first object of the present invention is to provide a modular connector which can minimize the side-by-side space between the mating connectors received therein;

A second object of the present invention is to provide a modular connector which can be securely assembled and is fitted with indicating devices for signaling circuit transmission.

A third object of the present invention is to provide a modular connector which can prevent the conductive contacts therein from breaking off during mating.

A fourth object of the present invention is to provide a modular connector including two different ports thereof respectively with different lateral dimensions and different front-to-back (depth) dimension.

A modular connector of the present invention comprises an insulative housing, terminal modules, a shell and indicating devices. The insulative housing defines at least two mating cavities in a front portion and two arranging openings communicating with the mating cavities in a top portion thereof, both of which are adapted for insertion of mating connectors. A first receiving groove is defined in the housing at one side of each arranging opening for accommodating an indicating device. Second receiving grooves are defined in a rear wall of the insulative housing in communication with respective first receiving grooves. Insert openings are defined in a bottom wall of the insulative housing for insertion of corresponding terminal modules. Each terminal module comprises a plurality of conductive contacts molded in a spacer and is inserted into the insulative housing from the insert opening thereof. The shell encloses the insulative housing to provide EMI shielding. A front side of the shell defines receiving openings aligned with the mating cavities of the insulative housing and apertures aligned with the first receiving grooves in the insulative housing. The indicating devices are received in the first and second receiving grooves of the insulative housing. A front end of each indicating device extends out of an aperture of the shell to show the state of circuit transmission.

Other objects, advantages and novel features of the invention will become more apparent from the following detailed description of the present embodiment when taken in conjunction with the accompanying drawings.

DETAILED DESCRIPTION OF THE INVENTION

Figure 1:
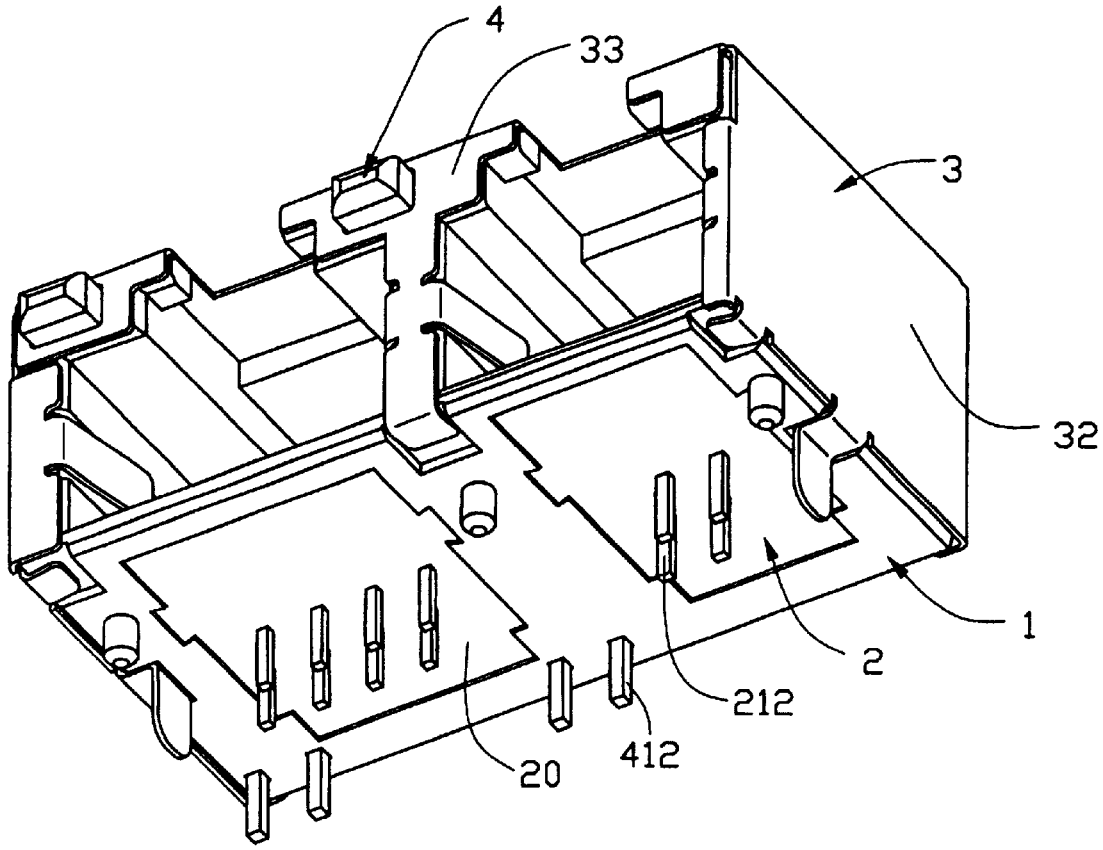
FIG. 1 is a perspective view of a modular connector of the present invention.
Figure 2:
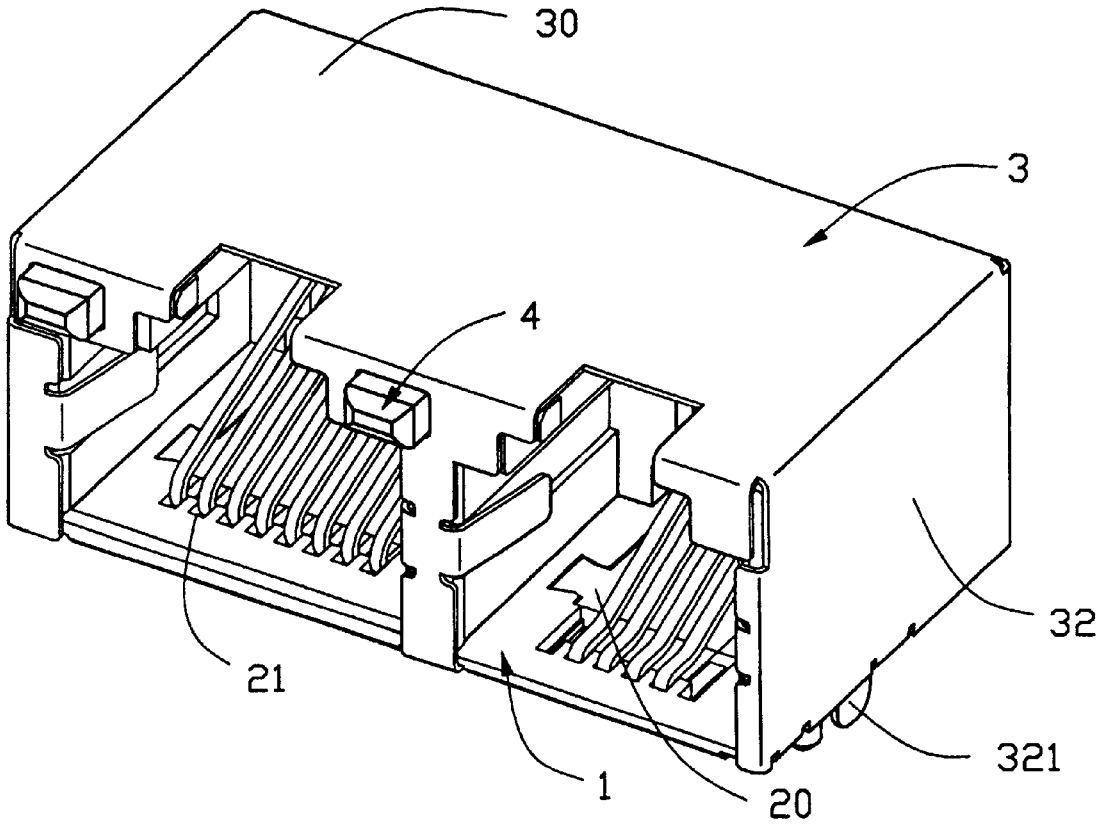
FIG. 2 is a perspective view of FIG. 1 from another aspect.
Figure 3A:
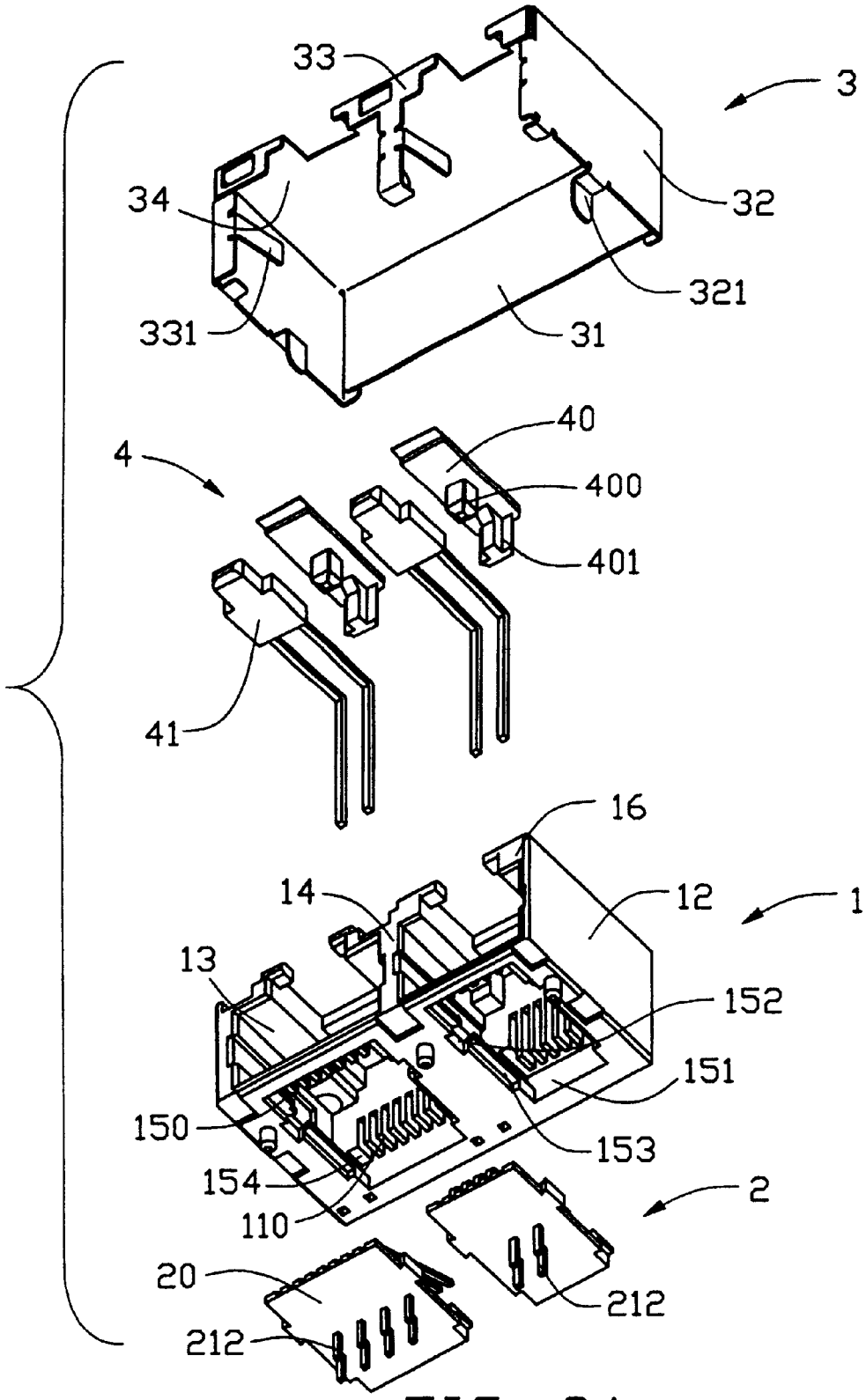
FIG. 3A is an exploded perspective view of FIG. 1 from a bottom aspect.
Figure 3B:
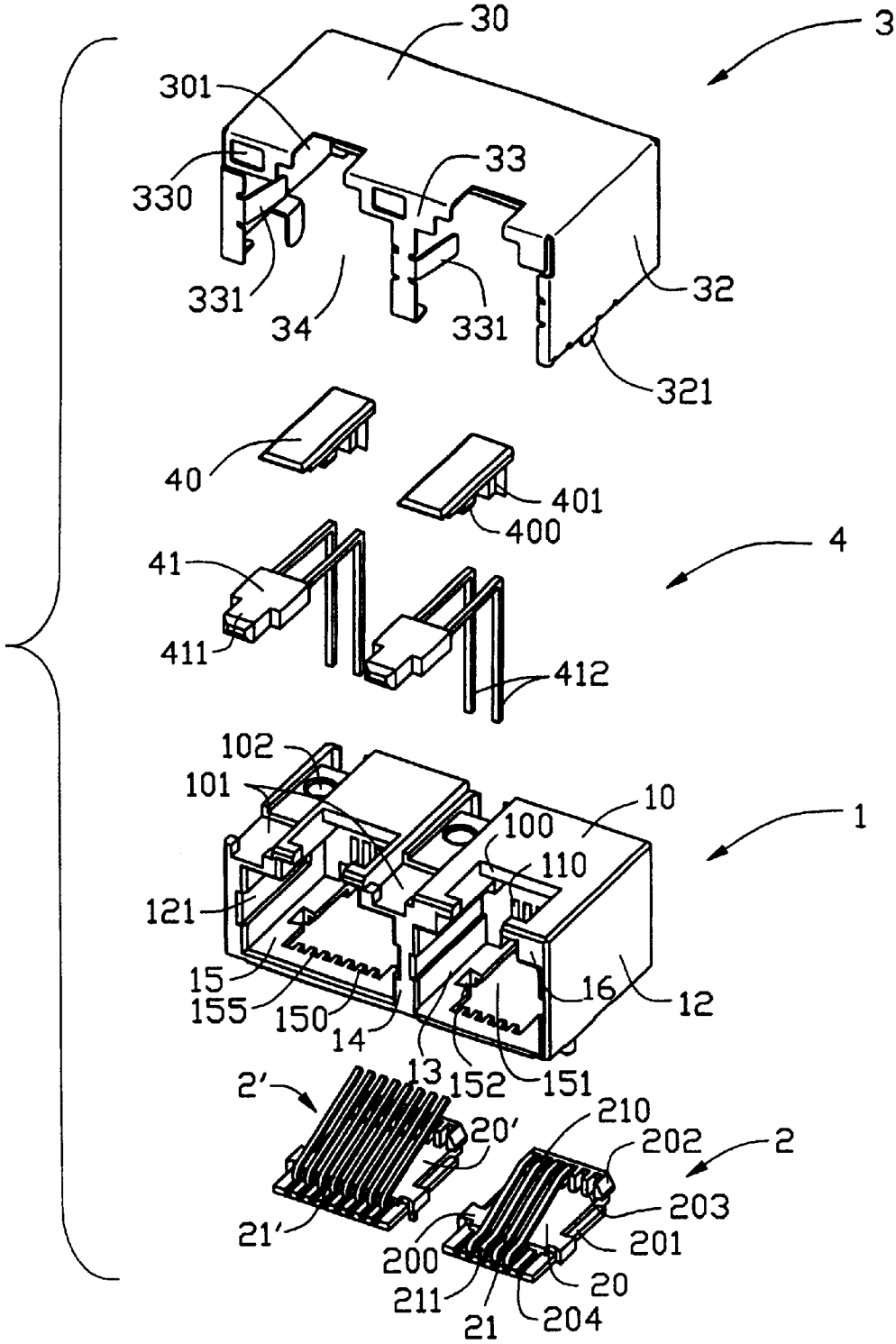
FIG. 3B is an exploded perspective view of FIG. 1 from a front aspect.
Figure 3C:
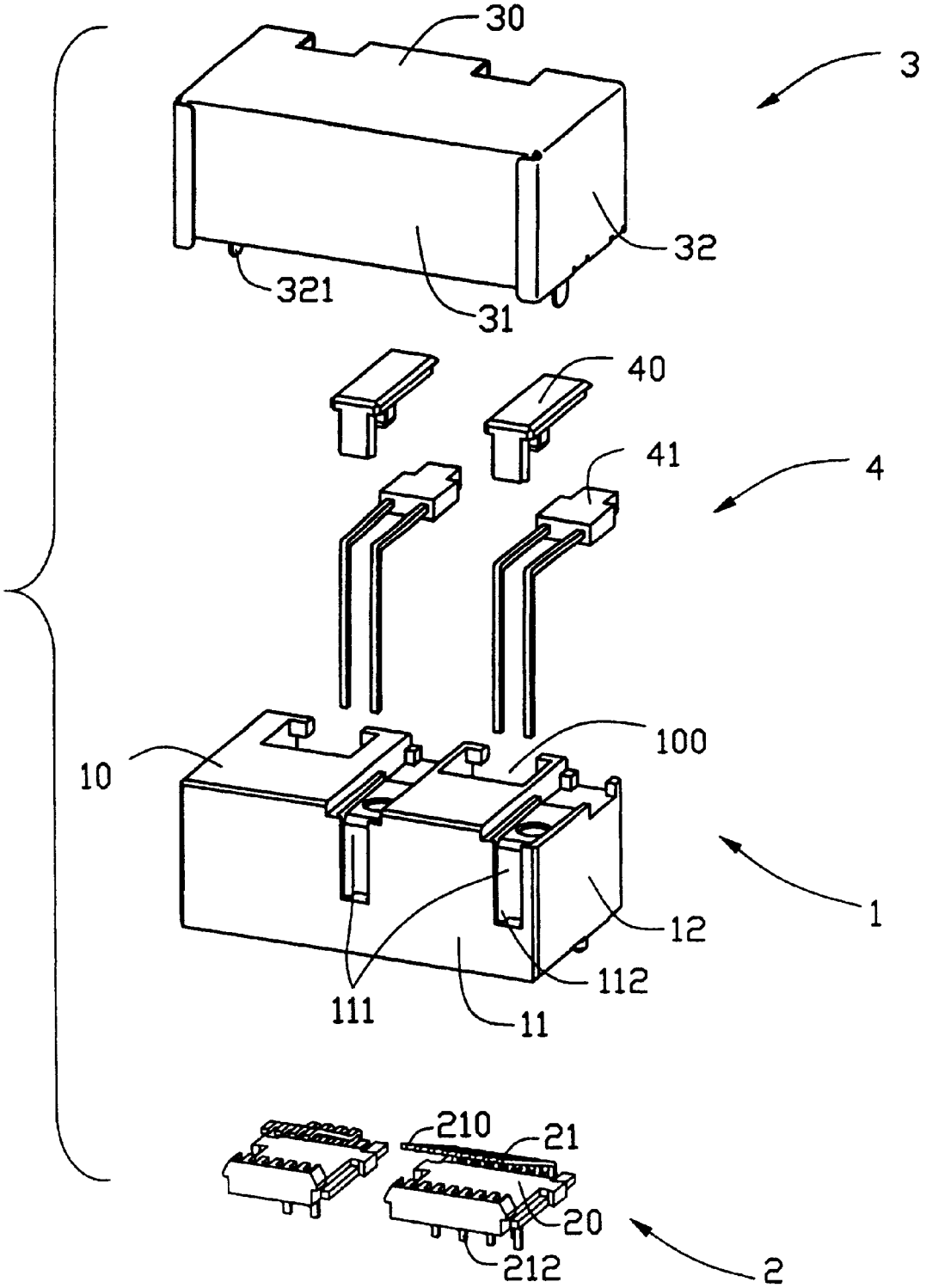
FIG. 3C is an exploded perspective view of FIG. 1 from a rear aspect.
Figure 4:
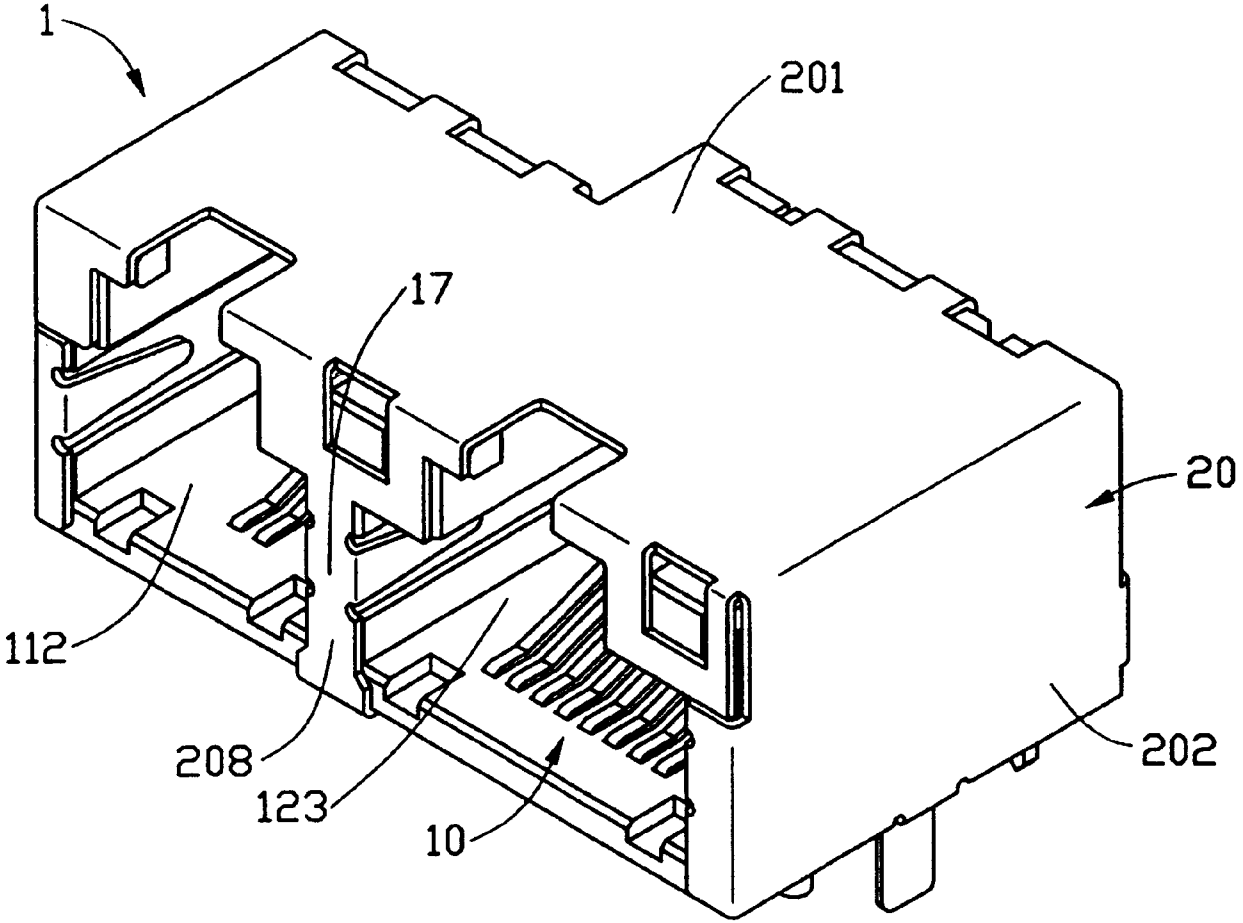
FIG. 4 is a perspective view of a second embodiment of the modular connector.
Figure 5:
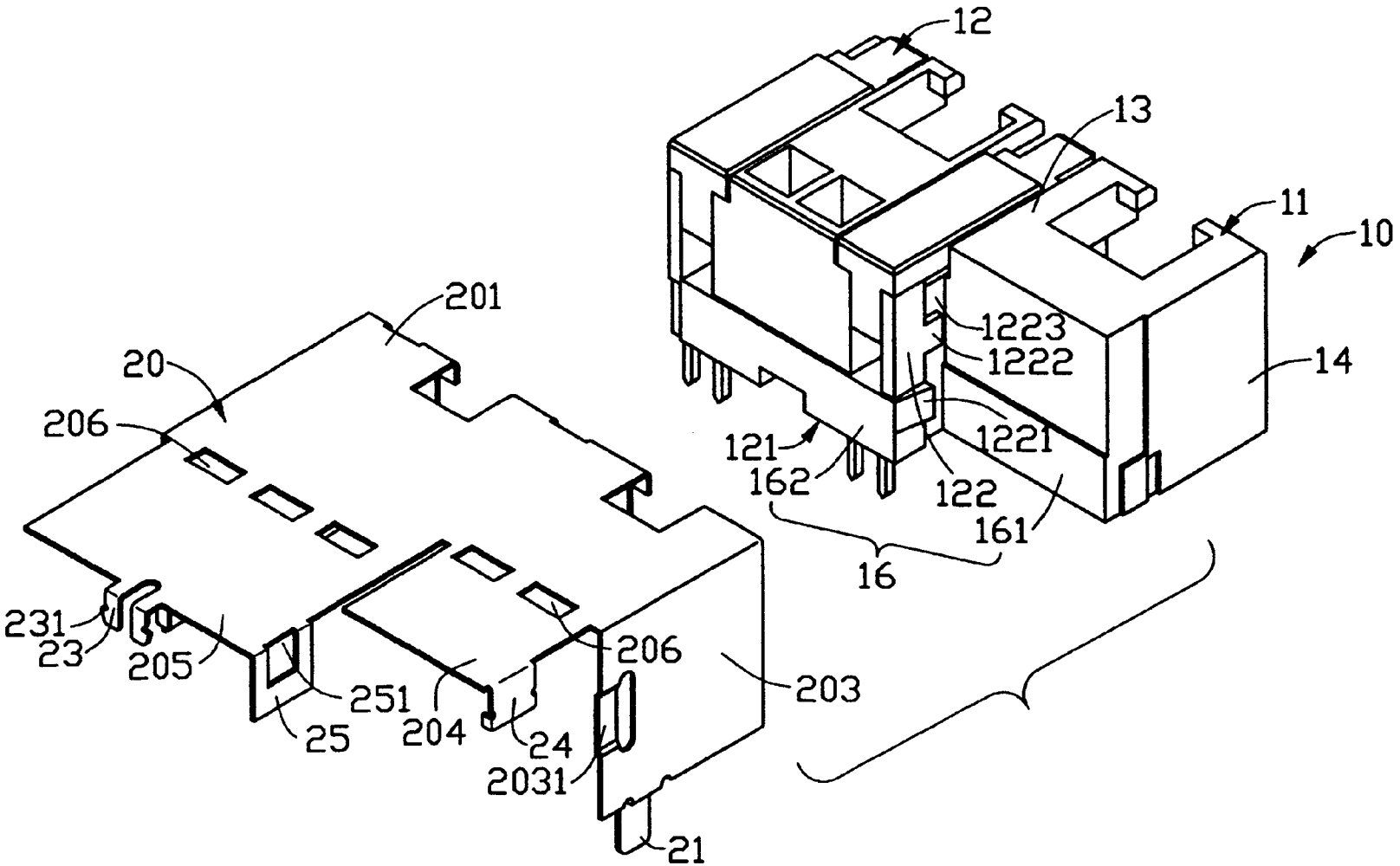
FIG. 5 is an exploded perspective view of the modular jack of FIG. 4.
Figure 6:
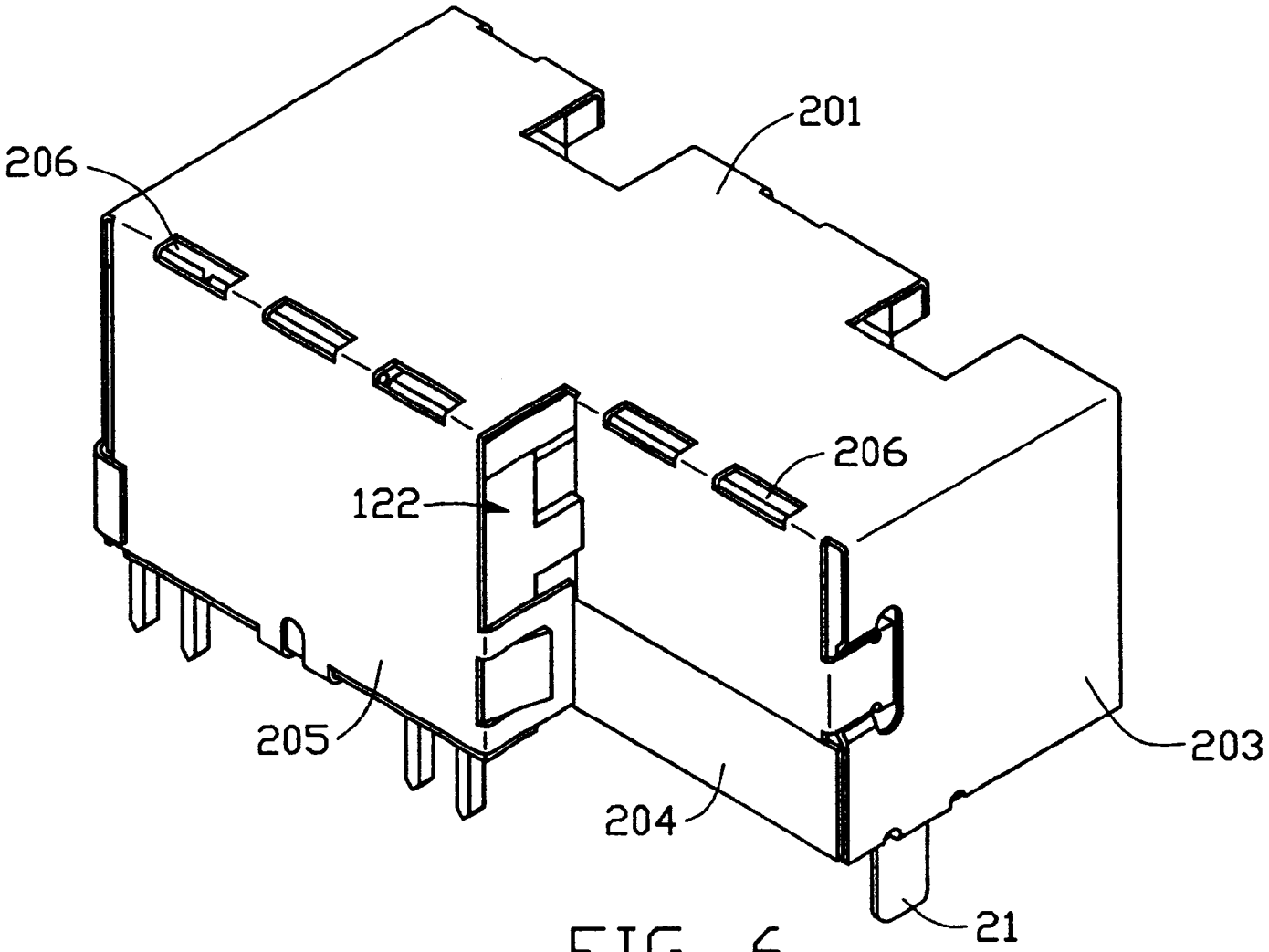
FIG. 6 is another perspective view of the modular jack of FIG. 4.
Figure 7:
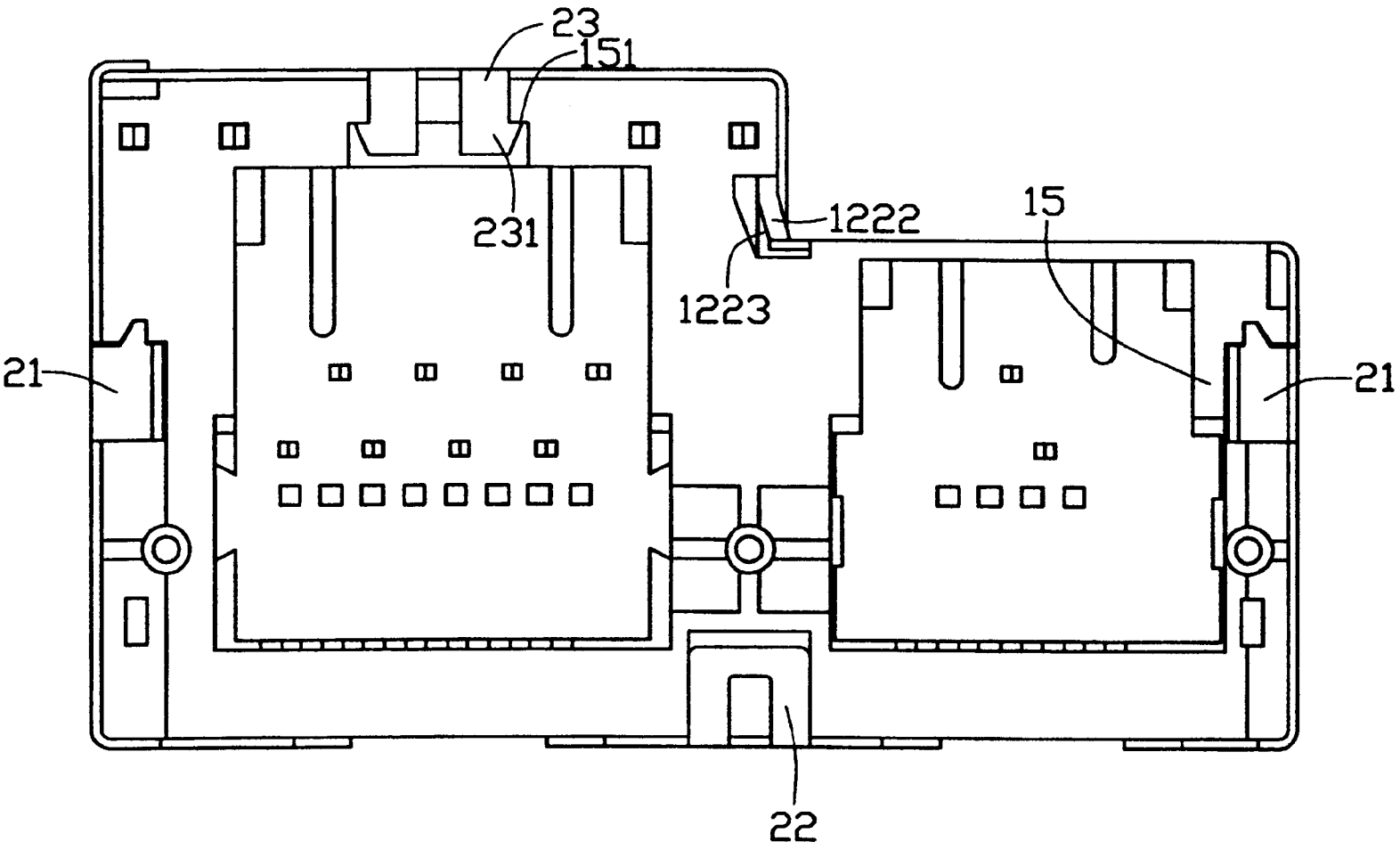
FIG. 7 is a bottom view of the modular jack of FIG. 4.
Figure 8:
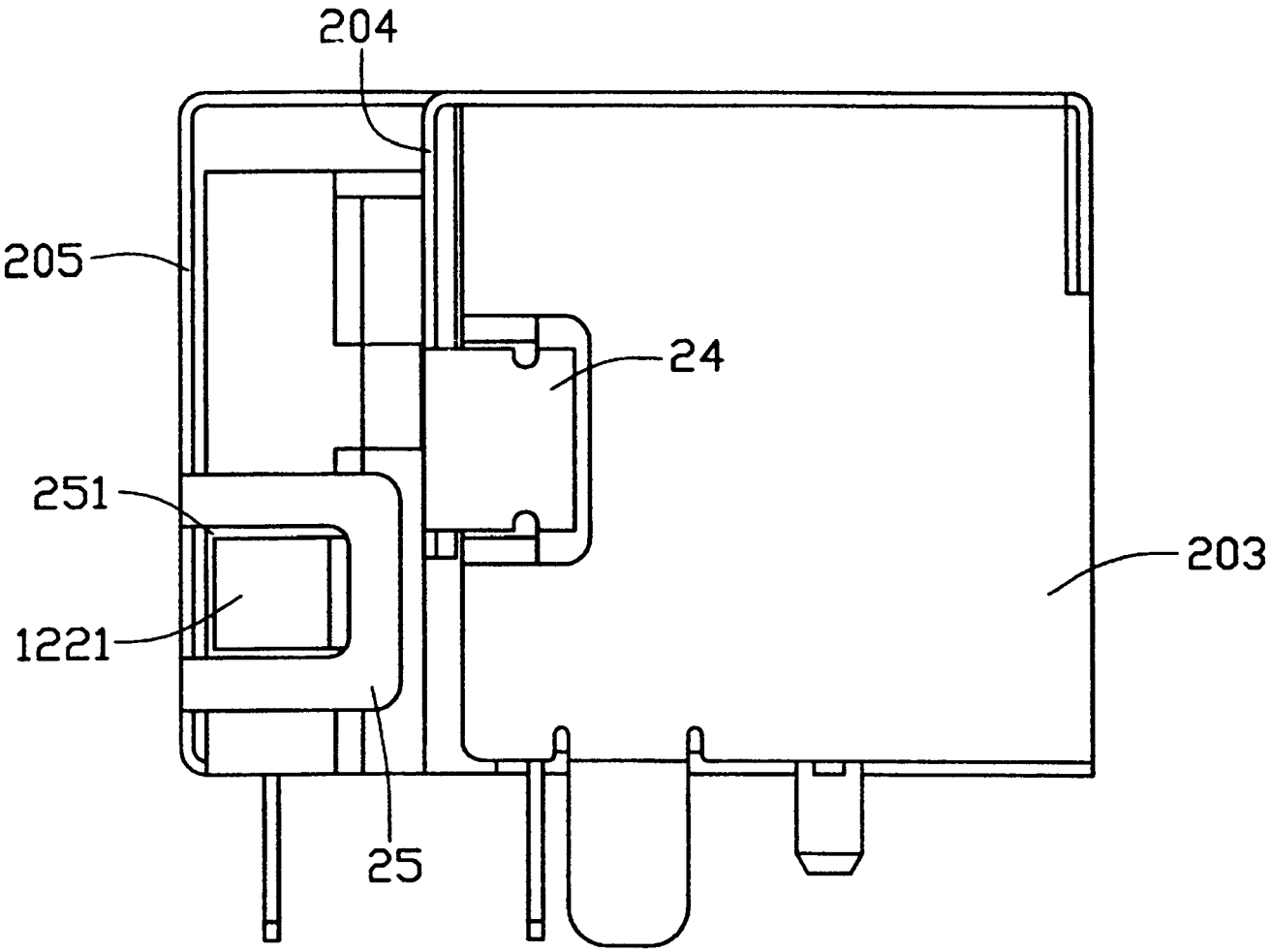
FIG. 8 is a side view of the modular jack of FIG. 4.
Figure 9:
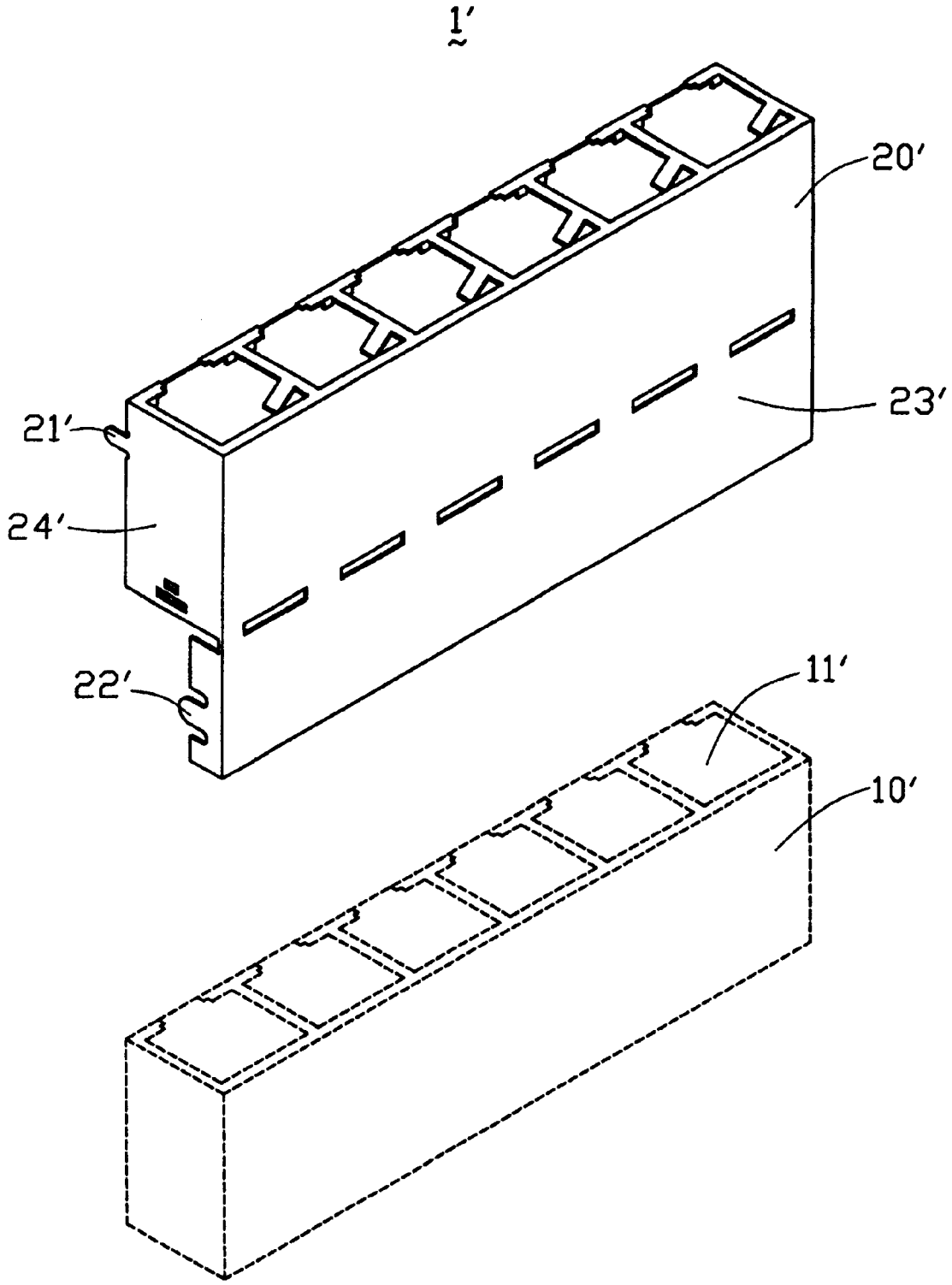
FIG. 9 (PRIOR ART)
FIG. 9 is an exploded perspective view of a conventional modular jack assembly.

Referring to FIGS. 1, 2, 3A and 3B, a modular connector of the present invention generally composed of a large unit and a small unit side by side integrally arranged together, comprises an insulative housing 1, terminal modules 2 and 2', a shell 3 and indicating devices 4. The insulative housing 1 is in a rectangular shape and comprises a top portion 10 and an opposed bottom wall 15, a front portion 16 and an opposed rear wall 11 (referring to FIG. 3C), and two opposite side walls 12. The insulative housing 1 defines at least two mating cavities 13 (one large and one small) opened at the front portion 16 and a like number of corresponding arranging openings 100 opened at the top portion 10 and communicating with a corresponding mating cavity 13, each mating cavity 13 and corresponding arranging opening 100 adapted for cooperatively receiving a mating connector (not shown). The mating cavities 13 are separated by a separating wall 14. A first receiving groove 101 is defined at one side of each arranging opening 100 and extends longitudinally through the top portion 10. A hole 102 is defined in the bottom surface of each first receiving groove 101. The rear side 11 defines a second receiving groove 111 for each first receiving groove, each of which communicates with and is perpendicular to the corresponding first receiving groove 101 in the top portion 10. A pair of through holes 112 is defined at both sides of each second receiving groove 111 and extending through the rear wall 11 of the insulative housing 1. The bottom wall 15 defines at least two insert openings 151 square in shape and communicating with a corresponding mating cavity 13. A plurality of projections 150 extends rearward from a front side of each insert opening 151 and are separated by a plurality of channels 155 therebetween. A pair of dovetail cutouts 152, stopping grooves 153 and recesses 154 (referring to FIG. 3A) are defined in both sides of each insert opening 151. Additionally, a plurality of guide grooves 110 are defined in an inside surface of the rear wall 11 and communicating with each mating cavity 13.

The terminal modules 2 and 2' have a similar structure, so only the terminal modular 2 is detailed hereinafter. The terminal modular 2 comprises a plurality of conductive contacts 21 being injection molded in a spacer 20. A pair of latching lugs 200, abutting blocks 201 and protrusions 202 are formed at both sides of the spacer 20. Additionally, the spacer 20 defines a plurality of retaining channels 204 in a front portion and forms a plurality of latching pins 203 at a rear end thereof. The conductive contacts 21 each comprise a contacting portion 210, a retaining portion 211 and a soldering portion 212 (referring to FIG. 3A). The retaining portions 211 thereof are integrally molded into the retaining channels 204 to retain the conductive contacts 21. The contacting portion 210 of each conductive contact 21 extends rearward and upward from the retaining portion 211. The soldering portions 212 extend downward from the spacer 20 for soldering to a printed circuit board (not shown).

Since the side walls 12 and the separating wall 14 of the insulative housing 1 do not need to provide any fixing devices for retaining inserted mating connectors, the width of the modular connector of the present invention is minimized. Additionally, the terminal modules can not be pushed out of place by repeated insertion of the mating connectors since the mating connectors are inserted perpendicular to the direction of the modules' insertion and the modules are securely retained in the insulative housing 1.

The conductive shell 3 is integrally formed for enclosing the insulative housing 1 to provide EMI shielding and comprises a front side 33 and an opposite rear side 31 (referring to FIG. 3C), a top side 30 and two opposite lateral sides 32. The front side 33 defines at least two receiving openings 34 and apertures 330 for correspondingly aligning with the mating cavities 13 and the first receiving grooves 101 of the insulative housing 1 respectively. A pair of grounding arms 331 are formed at either side of each receiving opening 34 and extend rearward from the front side 33 to conductively contact the mating connector. The top side 30 also defines at least two arranging apertures 301 for aligning with the arranging openings 100 in the insulative housing 1. The opposite lateral sides 32 define a pair of boardlocks 321 depending from bottom edges thereof to latched in a printed circuit board.

The indicating devices 4 each comprise a cover 40 and a light emitting diode (LED) 41. The cover 40 forms a protrusion 400 and an engaging portion 401 both of which depend downward from a bottom surface thereof. The lighting emitting diodes 41 each form a front end 411 and a pair of terminals 412 for signaling circuit transmission.

In assembly, the terminal modules 2 and 2' are inserted into the insert openings 151 from the bottom wall 15 of the insulative housing 1 and are retained therein by the latching lugs 200, abutting blocks 201 and protrusions 202 engaging respectively with the cutouts 152, stopping grooves 153 and recesses 154 of the insulative housing 1. Latching pins 203 of the spacer 20 partially engage with the guide grooves 110 in the insulative housing 1, and retaining portions 211 of the conductive contacts 21 engage with the channels 155 in the insulative housing 1. Each indicating device 4 is fitted in a corresponding first receiving groove 101 of the insulative housing 1 and the pair of terminals 412 thereof are inserted through the corresponding pair of through holes 112 in the rear wall 11 of the insulative housing 1. Each light emitting diode 41 is fixed in the insulative housing 1 by the cover 40, the protrusion 400 thereof being latched in the hole 102 and the engaging portion 401 thereof engaging with the second receiving groove 111. The shell 3 then encloses the insulative housing 1, the front ends 411 of the light emitting diodes 411 extending through the apertures 330 and the grounding arms 331 extending into grooves 121 defined in either side of each mating cavity 13.

It is noted that in this embodiment, the both two indicating devices 4 are positioned around the unit having the large cavity 13, and the side wall 12 beside the small cavity 13 is thinner than the other side wall 12 beside the large cavity 13. The arrangement allows the overall size of the whole assembly to have a minimum dimension thereof while still keeping proper reliable positioning and functioning of the built-in indicating device 4 thereof.

FIGS. 4–8 show the second embodiment of the invention wherein the connector 1 including an insulative housing 10 enclosed in the metal shield 20. The housing 10 composed of a first portion 11 and a second portion 12, includes a top wall 13, two side walls 14, a bottom wall 15 and a rear wall 16. Different from the first embodiment, the rear wall 16 defines a first rear section 161 and a second rear section 162 wherein the second rear section 162 projects rearward over the first section 161 to form a protrusion 121 thereof. A vertical wall 122 is formed on the protrusion 121 adjacent to the first section 161. A recess 1223 is formed around the intersection of the vertical wall 122 and the first section 161 with a block 1222 and a locking block 1221 formed on the vertical wall 122.

The shield 20 including a top face 201, two side faces 202, 203. A first rear face 204 and a second rear face 205 extend from a rear edge of the top face 201 corresponding to the first rear section 161 and the second rear section 162 respectively. There are a plurality of holes 206 around the intersection of the top face 201 and the first and second rear sections 161, 162 for easy forming/bending the whole shield 20.

The side faces 202, 203 cover the side walls 14 with downwardly extending board locks 21. The first portion defines a first cavity 112 and the second portion 12 defines a second cavity 123 with a partition 17 therebetween. The top face 201 covers the top wall 13 with a strip 208 downwardly extending from a front edge thereof wherein said strip 208 is equipped with a securement tag 22 for engagement with the bottom wall 15. The second rear face 205 includes a securement lock 231 to latchably engage the corresponding locking block 151.

The first rear face 204 and the second rear face 205 both are bent around the intersection having holes 206 therein. The first rear face 204 covering the first rear section 161, includes a securement tab 24 engaged with the recess 2031 in the side face 203. The other side edge of the rear face 204 is pressed against by the block 1222. The second rear face 205 covering the second rear section 162, includes a locking tab 25 having therein a locking opening 251 latchably engaged with the locking block 1221. Under this condition, the first and the second rear face 204, 205 can be securely fixed on the back of the connector 1.

It is noted that the second portion 12 is larger than the first portion 11 in both the lateral direction and the front-to-back direction, and therefore the corresponding rear face of the shield are divided into two pieces, i.e., the first rear face 204 and the second rear face 205, respectively engageably abutting against the corresponding first and second rear sections 161, 162 which are offset from each other along the front-to-back direction. Under this structure, the two LED devices (not labeled) are intentionally respectively positioned on two upper corners of the second portion 12, where the thickness of the corresponding receiving portion are larger than that of the first portion 11, for reliable securement.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the rear face may extend from the side face rather than the top face. Or the corresponding securing tag 22, securing tab 24, securing lock 231, locking tab 25 may be optionally alternatively engaged with either the housing or the shield itself, as long as the rear face can be securely attached on the back of the connector 1.

What is claimed is:

1. A modular jack comprising:

an insulative housing having first and second portions defining two different cavities therein for respectively receiving two differently sized, said second portion and said second cavity being larger than the first portion, and the first cavity, respectively, in both lateral and front-to-back directions;

said housing including a rear wall defining first and second rear sections offset from each other in said front-to-back direction;

a metal shield including a top face, two side faces, and first and second rear faces; wherein the first rear face and the second rear face cover the corresponding first rear section and second rear section, respectively;

wherein the first rear face and the second rear face respectively include securing devices for securing the first rear face and the second rear face against the corresponding first rear section and second rear section;

wherein two LED devices are respectively positioned on two upper corners of the second portion;

said insulative housing further defining a top portion and an opposite bottom portion;

the bottom portion defining an insert opening for each cavity;

a plurality of grooves formed in the rear sections;

terminal modules each comprising a spacer with a plurality of conductive contacts thereof, said terminal modules upwardly assembled to the respective insert opening of the bottom portion with said conductive contacts extending through said insert opening and into the cavity; and said terminal modules being secured to said housing.

* * * * *